United States Patent [19]

Gerling et al.

[11] Patent Number: 5,069,808

[45] Date of Patent: Dec. 3, 1991

[54] WASHING OR DETERGENT COMPOSITION CONTAINING LACTOBIONIC ACID OR LACTOBIONIC ACID SALTS

[75] Inventors: Klaus-Guenter Gerling, Laatzen; Detlef Wilke, Wennigsen, both of Fed. Rep. of Germany

[73] Assignee: Kali-Chemie AG, Hanover, Fed. Rep. of Germany

[21] Appl. No.: 505,569

[22] Filed: Apr. 6, 1990

[30] Foreign Application Priority Data

Apr. 29, 1989 [DE] Fed. Rep. of Germany ..... 3914293

[51] Int. Cl.[5] ..... C11D 7/54; C11D 3/22; C11D 3/04

[52] U.S. Cl. ..... 252/99; 252/174.17; 252/174.18; 252/DIG. 11; 252/135; 252/180; 252/181

[58] Field of Search ..... 252/174.18, 135, 174.19, 252/DIG. 11, 99, 180, 181

[56] References Cited

U.S. PATENT DOCUMENTS

| | | | |
|---|---|---|---|
| 3,062,878 | 11/1962 | Karabinos et al. | 252/DIG. 11 |
| 3,256,203 | 6/1966 | Robertson et al. | 252/181 |
| 3,634,392 | 1/1972 | Lyness et al. | 252/174.18 |
| 3,849,341 | 11/1974 | Lamberti | 252/DIG. 11 |
| 4,000,083 | 12/1976 | Heesen | 252/135 |
| 4,938,961 | 7/1990 | Collins | 424/606 |

FOREIGN PATENT DOCUMENTS

| | | | |
|---|---|---|---|
| 98108 | 1/1984 | European Pat. Off. . | |
| 852958 | 11/1960 | United Kingdom | 252/174.18 |

*Primary Examiner*—Paul Lieberman
*Assistant Examiner*—Cynthia Leslie
*Attorney, Agent, or Firm*—Foley & Lardner

[57] ABSTRACT

Washing and detergent composition are described which contain surfactants, optional bleaching agents and other conventional constituents of washing and detergent compositions, and also lactobionic acid and/or lactobionic acid salts as biodegradable and ecologically acceptable washing agent builders.

12 Claims, No Drawings

WASHING OR DETERGENT COMPOSITION CONTAINING LACTOBIONIC ACID OR LACTOBIONIC ACID SALTS

BACKGROUND OF THE INVENTION

This invention relates to compositions for washing and cleaning purposes which contain biodegradable and ecologically acceptable builder substances, to the use of these builder substances and to a method for washing and/or cleaning.

Builders (so-called detergent intensifiers) are of central importance for the running of the washing and cleaning operation. The function of the builders is primarily to eliminate from the washing or cleaning process the calcium and magnesium ions originating partly from the water, partly from dirt or for instance from textiles, by forming complexes or ion exchange and to support the action of surfactants. Modern builders therefore must satisfy a number of suitability criteria.

Besides the already mentioned complexing or ion exchange function for alkaline earth ions, builders should have a certain primary washing or cleaning action. This is understood to mean, for instance, a good specific washing and cleaning action for pigments and fats, or, for instance, a good washing action for certain textile fibers, the improvement of the surfactant properties and a favorable effect on the foaming properties. In particular, in addition to the aforementioned functions the builders should contribute substantially to the dispersion of dirt in washing and cleaning solutions. This means, for example, that greying and yellowing of the textiles to be washed is inhibited, which is very important for good successful washing.

As secondary properties, builders should demonstrate a good dirt-carrying capacity and prevent incrustation on textiles. Furthermore, they should also prevent corresponding deposits in washing machines and exhibit desirable, e.g. non-corrosive, behavior.

Furthermore, the builder substances should be chemically resistant, technically easy to process, non-hygroscopic, stable during storage and compatible with other constituents of washing and cleaning compositions. They should also have satisfactory color and odor qualities and be based on safe raw materials.

Besides human-toxicological harmlessness, the builder substances should furthermore be harmless to the environment, biodegradable, and last but not least, also meet economic requirements.

Builder substances known in the prior art include, for example, certain washing alkalis (such as soda, sodium silicate or sodium monophosphate), complexing agents (such as sodium diphosphate, sodium triphosphate, phosphonic acid derivatives, nitrilotriacetic acid (NTA), ethylenediaminetetraacetic acid (EDTA), citric acid, O-(carboxymethyl)malic acid) or ion exchangers (e.g. zeolites).

Washing alkalis such as soda or monophosphate are currently regarded as technically outmoded because they produce precipitates with the calcium and magnesium salts (so-called hardness salts) of tap water which collect on the washing and equipment as unwanted and troubling deposits. In contrast, currently used builder substances no longer precipitate hardness salts from the water, but eliminate them by forming complexes or by ion exchange. However, the phosphates used as complexing agents contribute to the eutrophication of stagnant or slow-flowing water. The ecological consequences which accompany the use of phosphates are undesirable and have led to an intensive worldwide search for suitable substitutes. However, known substitutes also have a number of drawbacks, since on one hand, like NTA or EDTA, for instance, they are poorly biodegradable, or on the other hand, like citric acid or O-(carboxymethyl)malic acid, they have a comparatively low dispersing power and only a moderate primary washing action. Ion exchangers such as zeolites again demonstrate very pronounced ion exchange abilities, but from an ecological point of view this can be objectionable with regard to heavy metal ions. Furthermore, in order to support the ion exchange taking place in the heterogenous phase, it is necessary to use the zeolites in combination with water- soluble complexing agents (for instance the aforementioned, but objectionable complexing agents such as NTA or EDTA) or carboxylic acid polymers (utilization of the so-called carrier effect). It is also a disadvantage that zeolite crystals may act as a condensation surface for poorly soluble compounds in the washing or cleaning solution, and that they exhibit hardly any dispersing action.

SUMMARY OF THE INVENTION

It is therefore the object of the present invention to provide washing and detergent compositions which avoid or at least reduce the drawbacks associated with the builder substances used in prior art compositions.

Another object is to provide builder substances which can be used in washing and cleaning compositions and/or processes, and which in addition to exhibiting satisfactory calcium chelating power, ecological compatibility and biodegradability, are distinguished by very good dispersing action needed to achieve a good washing and cleaning action.

These and other objects of the invention are achieved by providing a washing or detergent composition comprising a surfactant, a boron/oxygen compound, and lactobionic acid or a lactobionic acid salt as a builder.

According to a further aspect of the invention, the objects of the invention are achieved by providing a detergent ingredient composition comprising lactobionic acid or a lactobionic acid salt as a builder in combination with at least one conventional detergent ingredient.

DETAILED DESCRIPTION OF PREFERRED EMBODIMENTS

The invention proposes washing and detergent compositions which contain surfactants and optionally other constituents commonly found in washing agents and detergents, and which also contain lactobionic acid and/or lactobionic acid salts in the presence of a boron/oxygen compound as builder substances.

Lactobionic acid (4-(beta-D-galactosido)-D-gluconic acid) is a known substance which may be. obtained, for instance, by oxidation of lactose. In the past, lactobionic acid has been used pharmaceutically in the form of the calcium salt in the so-called calcium preparations for preventing and treating calcium deficiency conditions. Its use as a builder in washing agents and detergents, however, has not yet been described.

In principle, both free lactobionic acid itself and salts thereof with environmentally acceptable metal cations which do not form hardness salts or mixtures of these substances can be used as builder substances in the compositions according to the invention. Alkali metal lactobionates, particularly sodium and potassium lactobionate, are preferably used.

The lactobionic acid and/or lactobionic acid salts may be contained in the compositions according to the invention in conventional quantities for builder substances. In general, the lactobionic acid and/or salts thereof may then be present in the washing and detergent compositions in a quantity of up to 40% by weight relative to the total composition. Preferably, however, the quantity of the builder substances contained in the compositions according to the invention is up to 35% by weight.

In addition to lactobionic acid and/or salts thereof which are used as builder substances in the washing and detergent compositions according to the invention, these compositions contain another constituent which consists of one or more boron/oxygen compounds. The presence of the boron/oxygen compound intensifies the builder action of the lactobionic acid or the salts thereof in an unexpected and surprising manner. The boron/oxygen compounds are generally present in the compositions in such a quantity that at least one mole of boron is contained per mole of lactobionic acid and/or lactobionic acid salt. Suitable boron/oxygen compounds for this purpose include, for example, conventional borates known in the prior art such as sodium borate, sodium metaborate, borax, pentaborate, etc. or mixtures thereof. Boron/oxygen compounds of the aforementioned type are particularly contained in those compositions which do not contain a bleaching agent or perborate bleaching agent.

Furthermore, boron/oxygen compounds containing peroxide groups (i.e. boron-containing peroxide bleaching agents) may also be used as boron/oxygen compounds, for instance those perborates known per se in the prior art, which are conventionally contained as bleaching agents in washing and detergent compositions. The perborates are used in the washing and detergent compositions in quantities conventional for bleaching agents, and in such a case it is not necessary to add any additional boron/oxygen compounds of the type described above (i.e. borates etc.).

Although lactobionic acid and the salts thereof can be used per se according to the invention as builders for any washing and detergent compositions, e.g. also in liquid washing and detergent compositions (for instance liquid washing agents), but the advantages achievable with these builder substances appear especially in powdered washing and detergent compositions, for instance in powdered, so-called universal detergents, or in dishwasher detergents or detergents for hand dishwashing.

In one modification of the invention, it may also be advantageous to use the builder substances of the invention, i.e. lactobionic acid and/or salts thereof, as co-builders in combination with other organic and/or inorganic builders which have been conventional in prior art washing and detergent compositions. This is particularly advantageous for those uses in which only limited substitution of the conventional builder substances is permitted or appears desirable. Typical examples of conventional builders known in the prior art which may be contained in compositions as co-builders with the builders of the present invention include sodium aluminosilicates (e.g. zeolites), sodium citrate or salts of aminopolycarboxylic acids such as nitrilotriacetic acid and ethylenediaminetetraacetic acid. However, other known builder substances may also be contained in combination with lactobionic acid and/or salts thereof in washing and detergent compositions. In the above-mentioned compositions, lactobionic acid and/or salts thereof are present as co-builders in quantities of up to 25% by weight, relative to the total composition.

Besides the perborates already mentioned above, the compositions of the invention may contain any conventional bleaching agents or bleaching agent mixtures of the prior art, for instance chlorine bleaching agents or peroxide bleaching agents. In preferred compositions according to the invention, however, the bleaching agent is a peroxide bleaching agent, such as persulfate, percarbonate or perborate. The advantageous effects of the builder substances contained in the compositions according to the invention develop in a particularly advantageous manner when the compositions contain a perborate as a bleaching agent. Perborates such as sodium perborate tetrahydrate or sodium perborate monohydrate are particularly preferred.

The compositions according to the invention may be formulated in known manner. In addition to the builder substances, the boron/oxygen compound and the optionally present bleaching agents contained in the washing and detergent compositions according to the invention as already described above, any conventional materials which are usually used for formulating washing and detergent compositions may be used in conventional quantities in the compositions according to the invention. In particular, besides the aforementioned constituents, the compositions according to the invention contain surfactants as significant constituents and optionally other conventional adjuvants.

As surfactants, the compositions according to the invention may contain any surface active organic compounds, such as anionic, cationic, ampholytic or nonionic surface active agents or mixtures thereof.

Anionic surfactants are, for example synthetic, surface active compounds with one or more functional groups which ionize in aqueous solution to form negatively charged ions. Examples of suitable anionic surfactants include alkali metal, ammonium or alkanolamine salts of alkylbenzene sulfonates with 10 to 18 carbon atoms in the alkyl group; alkyl sulfates and alkyl ether sulfates with 10 to 24 carbon atoms in the alkyl group and with 1 to 5 ethylene oxide groups; $C_{10}$- to $C_{12}$-α-olefin sulfonates, and α-sulfo-fatty acid esters.

Cationic surfactants are surfactants with one or more functional groups which ionize in aqueous solution to form positively charged organic ions. Examples of cationic surfactants include aliphatic or aromatic higher alkyl-di-lower alkyl ammonium halides, e.g. dialkyldimethylammonium chlorides such as distearyldimethylammonium chloride; alkyldimethylbenzylammonium chlorides; and imidazolinium salts.

Ampholytic (zwitterion) surfactants are derivatives of straight-chain or branched aliphatic compounds, usually having 8 to 24 C atoms, which contain aliphatic quaternary ammonium, phosphonium or sulfonium groups and at least one anionic water-soluble group and optionally other substituents. Examples include are $C_{12}$- to $C_{18}$-alkylbetaines of the formula $R—N^+(CH_3)_2CH_2$-COO- and $C_{12}$- to $C_{18}$-alkylsulfobetaines of the formula $R—N^+(CH_3)_2(CH_2)_3$-$SO_3$-.

Non-ionic surfactants are usually co-condensates of ethylene oxide or propylene oxide with hydrocarbons which have reactive groups such as hydroxyl, carboxyl or amino groups. Examples include alkylphenol-polyglycol ethers having $C_8$- to $C_{12}$-alkyl radicals and 5 to 10 ethylene glycol units; alkylpolyglycol ethers, such as fatty alcohol-polyethylene glycol ethers and oxoalcohol-polyethyleneglycol ethers; and fatty acid alkanolamides, for instance of the fatty acid-ethanolamide type.

Other non-ionic surfactants include the semi-polar non-ionic surfactants, e.g. water-soluble amine-oxides with alkyl or hydroxyalkyl units containing 8 to 28 carbon atoms, wherein two of these alkyl or hydroxyalkyl units may optionally be linked to form a ring structure with 1 to 3 carbon atoms.

The washing and detergent compositions of the present invention may contain additional additives conventionally used for formulating washing agents and detergents. Such additives include intensifiers, washing agent enzymes, enzyme stabilizers, dirt carriers and/or compatibilizing agents, complexing agents and chelating agents, soap foam regulators and additives such as optical brighteners, opacifying agents, corrosion inhibitors, anti-electrostatic agents, dyes, bactericides, bleach activators and peracid bleaching agent precursors.

Thus, a typical example composition of a washing agent according to the invention may contain:

a) at least 5% by weight of a surfactant or surfactant mixture, b) up to 40% by weight lactobionic acid and/or lactobionic acid salt builder, inclusive of the proportion of other builder substances contained in the composition, c) up to 40% by weight of a sodium perborate, and d) other constituents such as adjuvants to make up to 100% by weight.

In another variant, the invention also relates to those compositions for washing and cleaning purposes or for bleaching purposes in washing and cleaning processes which contain lactobionic acid and/or lactobionic acid salts as builder substances, but which themselves are not yet complete washing and detergent compositions in the sense described above, since they only contain part of the constituents conventionally contained in a complete washing and detergent composition suitable for use. Such partial compositions according to the invention may on one hand serve for the industrial production of complete washing and detergent compositions. On the other hand, the partial compositions are well suited as constituents for so-called modular washing and detergent systems. In such modular systems, the constituents are not already mixed together as in conventional (complete) washing and detergent compositions, rather they are present as separate system components, e.g. as surfactant, bleaching agent and builder components. The relative quantities of the individual components are first determined by the user according to individual requirements (such as type of material to be washed or cleaned; type of washing or cleaning process, e.g. boil washing or fine washing etc; water hardness etc.). The components may either be mixed together before use and or added separately in measured quantities to the washing water.

It is not necessary for the compositions of this embodiment of the invention, i.e the partial compositions, that the lactobionic acid and/or the lactobionic acid salts already be mixed with a boron/oxygen compound, as long as it is ensured that when such partial compositions are used for industrial production of complete washing and detergent compositions, boron/oxygen compounds (as described above for complete washing and detergent compositions) are added, or that during the combination and use of the components of modular washing and detergent systems, the components containing lactobionic acid and/or lactobionic acid salts are combined according to the invention with another component containing the boron/oxygen compound.

In an advantageous refinement of this embodiment of the invention, the partial compositions already contain the lactobionic acid and/or lactobionic acid salt builder substances in combination with a boron/oxygen compound. The explanations given above for the boron/oxygen compound in the complete washing and detergent compositions apply analogously to the boron/oxygen compound present in these partial compositions.

In a particularly preferred embodiment of the partial compositions according to the invention, the boron/oxygen compound contained therein is a peroxide bleaching agent analogous to those described above in conjunction with the complete washing and detergent compositions. Preferred peroxide bleaching agents are perborates. Such partial compositions, for example in powder or granular form, which contain lactobionic acid and/or lactobionic acid salts in the presence of perborate, are suitable, for example, for use as so-called dry bleaches in washing and cleaning processes.

The invention further relates to the use of lactobionic acid and/or lactobionic acid salts as builder substances in compositions for washing and cleaning purposes. In this context, both the free lactobionic acid itself and also the salts thereof with environmentally acceptable metal cations which do not form hardness salts or mixtures of these substances, may be used as in the manner described above as builder substances for compositions according to the invention. It is preferred, however, to use the sodium or potassium salt of lactobionic acid in particular.

The invention further relates to a method of washing and cleaning in which lactobionic acid and/or lactobionic acid salts are used as builder substances in the presence of boron/oxygen compounds.

The compositions and methods of the invention, offer a surprising and problem-free solution to the frequently encountered need for suitable, environmentally acceptable and biodegradable builder substances, which in addition to good calcium binding capacity, demonstrate in particular very good dispersing action. Besides eliminating interfering cations such as calcium and magnesium, and in addition to having a good primary washing action, the very good dispersing action of the lactobionic acid and the salts thereof in the presence of a boron/oxygen compound leads to a reduction of greying and yellowing. This characteristic is of the greatest importance for washing and cleaning processes, and is outstandingly achieved by lactobionic acid and the salts thereof. Furthermore, incrustations, e.g. on textiles or in washing machines, are also prevented to an unexpectedly favorable extent. Furthermore, lactobionic acid and salts thereof also demonstrate the so-called threshold effect, i.e. they are capable of delaying or reducing the precipitation of insoluble salts, even when using less than stoichiometric quantities of builders, or at least of causing the insoluble salts to precipitate primarily in amorphous form so that formation of sharp-edged, fiber-damaging crystals (e.g. calcite crystals) is largely prevented. The compounds are chemically stable, non-hygroscopic, storage stable, and technically easy to handle. Furthermore, they are very compatible with the constituents of conventional washing agents and detergents. The compounds can easily be obtained from safe raw materials by oxidation of lactose, and are also advantageous from an economic point of view. The biological origin and complete biodegradability of the substances assures that they are non-toxic to humans and have advantageous environmental properties.

The following examples are intended to illustrate the invention in further detail, but without restricting its scope.

EXAMPLE 1

Sequestering ability

The calcium binding capacity of lactobionic acid in the presence of boron/oxygen compounds (2.13 g borax and/or 2 g sodium perborate in 100 ml solution) was determined at pH 10 by titrating 100 ml of an aqueous solution of 1% by weight lactobionic acid, 0.4% by weight sodium carbonate and optionally 0.1% by weight TAED bleach activator with an aqueous 0.1 N calcium chloride solution until permanent clouding occurred. Under these test conditions, the lactobionic acid exists in the test solution as the sodium salt. The number of grams of calcium ions which can be kept in solution under the above conditions per 100 g lactobionic acid builder substance is listed as the measured value of the calcium binding capacity.

The tests listed in the following table were carried out at room temperature.

| Test No. | Builder system | Calcium Chelating Power (g Ca/100 g Lactobionic Acid) |
|---|---|---|
| 1 | Lactobionic acid + borax | 8.16 |
| 2 | Lactobionic acid + borax | 8.8 |
| 3 | Lactobionic acid + borax | 8.4 |
| 4 | Lactobionic acid + borax | 8.44 |
| 5 | Lactobionic acid + borax | 7.45 |
| 6 | Lactobionic acid + sodium perborate* + TAED | 6.65 |
| 7 | Lactobionic acid + sodium perborate* + TAED + borax | 6.29 |
| 8 | Lactobionic acid + sodium perborate* + TAED + borax | 7.13 |

*in the form of the tetrahydrate

The tests show that builder systems with lactobionic acid have a considerable calcium binding capacity, i.e. clear sequestering ability.

EXAMPLE 2

Dispersing Power

The dispersing power of lactobionic acid in the presence of borax as a boron/oxygen compound (0.21 g in 100 ml solution) was investigated in comparison with other builder substances. In order to determine the dispersing power, aqueous dispersions were produced for this purpose comprising 0.1% by weight of the builder substance to be tested and 4% by weight of powdered graphite as dispersed material, by weighing the substances into a 100 ml shaking measuring cylinder, filling the cylinder with water to 100 ml and shaking it thoroughly for one minute. After standing for 24 hours, the sedimentation volume of the graphite particles in particular was determined as a measure of the dispersing power, and for supplementary investigations a sample was additionally removed from the dispersion at the level of the 70 ml measurement mark of the shaking measuring cylinder and was submitted to a photometric examination. The transmission of the samples compared with corresponding blank tests without graphite (transmission 100%) was thereby measured, with lower transmission values indicating better dispersing power.

a) Investigations on samples without separate adjustment of the pH value (intrinsic pH value of the builder substances):

| Test No. | Builder substance | Transmission in % at wavelength 480 nm | 700 nm | Sedimentation volume of the graphite in ml |
|---|---|---|---|---|
| 9 | Lactobionic acid & borax | 73.0 | 82.6 | 16.5 |
| 10 | Citric acid | 93.3 | 93.8 | 20 |
| 11 | NTA | 90 | 91.2 | 20 |
| 12 | STPP | 89.3 | 91.7 | 22.0 |

b) Investigation of Builder Samples which had been Adjusted to a pH value of 10 (with 5 N sodium hydroxide):

| Test No. | Builder substance | Transmission in % at wavelength 480 nm | 700 nm | Sedimentation volume of the graphite in ml |
|---|---|---|---|---|
| 13 | Lactobionic acid & borax | 78.6 | 84.3 | 18.5 |
| 14 | Citric acid | 88.0 | 92.0 | 21.0 |
| 15 | NTA | 87.3 | 92.6 | 21.5 |
| 16 | STPP | 90.8 | 94.2 | 19.5 |

The tests show that when lactobionic acid is used according to the invention as a builder substances (tests Nos. 9 and 13), considerably lower sedimentation volumes and lower transmission values occur than in the comparative tests 10 to 12 and 14 to 16. Lactobionic acid as a builder substance is therefore shown to have considerably better dispersing power than the prior art builder substances.

EXAMPLE 3

Perborate stability a) To investigate the influence of the builder on perborate stability, 250 ml of an aqueous solution adjusted to pH=10 (with 5 N NaOH) which contained 5 g builder substance, 5 g sodium perborate tetrahydrate, 0.02 g iron (III) chloride and optionally 10.25 g borax was heated to 90° C. in a water bath. In order to determine the active oxygen content, 50 ml samples were removed after 30 90 and 150 minutes for iodometric titration. For this purpose, 10 ml 4 N hydrochloric acid and 3 g potassium iodide were added to the 50 ml sample of solution and the sample was allowed to stand in the dark for 10 minutes. Then it was titrated with 1 molar sodium thiosulfate solution against starch as an indicator. The active oxygen content of the samples in % relates in each case to identically treated blank tests (100%) free of builder substance, but which otherwise have the same composition as the corresponding sample.

| Test No. | Builder System | Active oxygen content in % after 30 min | 90 min | 150 min |
|---|---|---|---|---|
| 17 | Lactobionic acid & borax | 10.6 | 8.3 | 7.3 |
| 18 | STPP | 10.3 | 8.6 | 8.2 |

The tests were repeated analogously to a) with aqueous solutions which in addition to the constituents listed above under a) also contained 0.25 g TAED as a bleaching agent activator in 250 ml solution.

| Test No. | Builder System | Active oxygen content in % after 30 min | 90 min | 150 min |
|---|---|---|---|---|
| 19 | Lactobionic acid & borax | 6.3 | 6.0 | 0 |
| 20 | STPP | 3.6 | 3.0 | 1.4 |

As can be seen from the comparison with the known builder STPP (comparative tests Nos. 18 and 20), the use of lactobionic acid as a builder substance according to the invention (tests 17 and 19 of this example) does not have a negative effect on the perborate stability. With respect to perborate stability, lactobionic acid behaves equally as well as the prior art builder.

In addition to the foregoing laboratory tests of Examples 1 to 3, the washing tests of the following Examples 4 to 6 also demonstrate the excellent properties of lactobionic acid with respect to its use as a builder substance in washing and detergent compositions.

EXAMPLE 4

Washing ability

The washing ability was determined by washing tests on test fabrics in two standard washing machines (Type: Miele W 180). For this purpose, 2 kg of test fabric were washed with 155 g detergent in the short cycle (wash duration=1 hour). A standardized complete washing agent formulation which contained 30% by weight of the builder system to be tested was used as the detergent. The composition of the standardized complete washing agent formulation was as follows:

30.0% by weight builder system (see Table)
11.9% by weight dodecylbenzene sulfonate
4.0% by weight tallow fatty alcohol ethoxylate with 11 moles ethylene oxide
4.0% by weight tallow soap
4.0% by weight sodium silicate
32.9% by weight sodium perborate tetrahydrate
1.9% by weight sodium sulfate
1.3% by weight tylose The tests were carried out at pH 10 and 18° dH at 30° and 60° C. The liquid ratio was 1:12. The washing ability was determined by measuring the whitening of soiled test fabrics (cotton fabric and cotton blend fabric) as the remission difference (remission of the dry test fabric after the washing test less the remission of the test fabric before the washing test) at 530 nm. A larger remission difference indicates a better washing ability. Lactobionic acid alone, lactobionic acid with zeolite (in a 1:1 ratio), and as a comparison STPP were used as builder systems in the complete washing agent formulations.

| Test No. | Builder Substance | Test Fabric | Wash Temp. in °C. | Remission Difference in % * |
|---|---|---|---|---|
| 21 | Lactobionic Acid | WFK-fabric PE/BW(20 C) | 30 | 21.67 |
| 22 | Lactobionic Acid + Zeolite | WFK-fabric PE/BW(20 C) | 30 | 20.44 |
| 23 | STPP | WFK-fabric PE/BW(20 C) | 30 | 19.26 |
| 24 | Lactobionic Acid | WFK-fabric PE/BW(20 C) | 60 | 27.14 |
| 25 | Lactobionic Acid + Zeolite | WFK-fabric PE/BW(20 C) | 60 | 27.98 |
| 26 | STPP | WFK-fabric PE/BW(20 C) | 60 | 24.08 |
| 27 | Lactobionic Acid | WFK-fabric BW (10 C) | 60 | 28.18 |
| 28 | Lactobionic Acid + Zeolite | WFK-fabric BW (10 C) | 60 | 23.76 |
| 29 | STPP | WFK-fabric BW (10 C) | 60 | 22.38 |
| 30 | Lactobionic Acid | EMPA-fabric PE/BW (104) | 60 | 29.30 |
| 31 | Lactobionic Acid + Zeolite | EMPA-fabric PE/BW (104) | 60 | 29.20 |
| 32 | STPP | EMPA-fabric PE/BW (104) | 60 | 37.16 |
| 33 | Lactobionic Acid | EMPA-fabric BW (101) | 60 | 23.24 |
| 34 | Lactobionic Acid + Zeolite | EMPA-fabric BW (101) | 60 | 21.26 |
| 35 | STPP | EMPA-fabric BW (101) | 60 | 29.53 |

* Average value from two washing tests

The tests according to the invention in this example (Nos. 21, 22, 24, 25, 27, 28, 30, 31, 33 and 34) shown that builder systems with lactobionic acid have comparable, in part even better, washing action compared with good builders of the prior art (comparative tests Nos. 23, 26, 29, 32 and 35) depending on the type of fabric.

EXAMPLE 5

Greying

In to make it clear to what extent the use of lactobionic acid as a builder substance prevents the greying of textiles, washing tests were carried out on bleached test fabrics without artificial soiling and without optical brighteners. The test fabrics were allowed to pass through a total of 25 washing cycles analogous to the washing conditions given in Example 4 at 60° C. in a normal cycle (steeping process=2 hours). Then the greying of the test fabric (woven cotton, toweling) was determined by measuring the remission at 530 nm. Lactobionic acid was used as the builder in the standardized complete washing agent formulation (see Example 4), and STPP was used as the comparison. The remission is indirectly proportional to the greying.

| Test No. | Builder Substance | Test fabric WFK | Remission in % after 0 Wash Cycles | 25 Wash Cycles |
|---|---|---|---|---|
| 36 | Lactobionic acid | Cotton (Type 10 C) | 91.69 | 92.60 |
| 37 | STPP | Cotton (Type 10 C) | 91.69 | 92.67 |
| 38 | Lactobionic acid | Toweling | 92.25 | 93.55 |
| 39 | STPP | Toweling | 92.25 | 92.61 |

The tests according to the invention of this Example (Nos. 36 and 38) show that when using lactobionic acid as a builder substance in washing and detergent compositions, the greying of textiles is prevented just as outstandingly as by known good builders of the prior art (comparative tests Nos. 37 and 39).

EXAMPLE 6

Incrustation

In order to determine the inorganic incrustation, washing tests were carried out on test fabrics. For this purpose, the test fabric was allowed to pass through a total of 25 washing cycles analogous to the washing conditions given in Example 4. After the washing cycles had ended, the test fabric was washed under known standard conditions and the remaining ash content in % by weight (relative to the test fabric used) was used as a measurement of the inorganic incrustation. Lactobionic acid was used as the builder in the standardized complete washing agent formulation (see Example 4), and STPP was used as a comparison. The smaller the remaining ash content, the lower the incrustation.

| Test No. | Builder Substance | Test fabric WFK | Ash content in % |
|---|---|---|---|
| 40 | Lactobionic acid | Cotton (Type: 10 C) | 0.19 |
| 41 | STPP | Cotton (Type: 10 C) | 0.20 |
| 42 | Lactobionic acid | Toweling | 0.44 |
| 43 | STPP | Toweling | 0.55 |

The tests according to the invention of this example (Nos. 40 and 42) show that depending on the type of fabric when using lactobionic acid in washing and detergent compositions, the incrustation of textiles is prevented somewhat better (cotton) or even much better (toweling) than by known good builders of the prior art (comparative tests 41 and 43).

| Abbreviations | |
|---|---|
| WFK | = Wäschereiforschung Krefeld (Krefeld Laundry Research Center) |
| PE/CO (20 C) | = Polyester/cotton (Type 20 C) |
| CO (10 C) | = Cotton (Type 10 C) |
| EMPA | = Eidgenossische Materialprufungsanstalt (Swiss Material Testing Institute) |
| PE/CO (104) | = Polyester/cotton (Type 104) |
| CO (101) | = Cotton (Type 101) |
| STPP | = Sodium tripolyphosphate or sodium triphosphate |
| NTA | = Nitrilotriacetic acid |
| TAED | = Tetraacetylethylenediamine |

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all modifications falling within the ambit of the appended claims and equivalents thereof.

What is claimed is:

1. A washing or detergent composition comprising a surfactant, a boron/oxygen compound, and lactobionic acid or a lactobionic acid salt as a builder, wherein said lactobionic acid or lactobionic acid salt is present in said composition in an amount in the range from an effective builder amount up to 40% by weight of the total composition, and said boron/oxygen compound is present in said composition in such an amount that the composition contains at least one mole of boron per mole of lactobionic acid or lactobionic acid salt.

2. A composition according to claim 1, wherein said boron/oxygen compound is a perborate.

3. A composition according to claim 1, wherein said composition is a powdered or granulated composition.

4. A composition according to claim 1, wherein said composition comprises a combination of said lactobionic acid or a lactobionic acid salt and at least one conventional builder substance as co-builders.

5. A composition according to claim 4, wherein said conventional builder substance is selected from the group consisting of zeolites, sodium citrate and aminopolycarboxylic acids.

6. A composition according to claim 4, wherein said lactobionic acid or the lactobionic acid salt is present as a co-builder in an amount of up to 25% by weight, relative to the total weight of the composition.

7. A builder composition for use in a detergent containing a boron/oxygen compound in an amount sufficient to provide at least one mole of boron for each mole of said builder, said builder comprising lactobionic acid or a lactobionic acid salt in combination with at least one conventional detergent ingredient, wherein said lactobionic acid or lactobionic acid salt is present in an amount in the range from an effective builder amount up to 40% by weight of the total detergent.

8. A composition according to claim 7, wherein said boron/oxygen compound is a perborate.

9. A composition according to claim 7, wherein said detergent ingredient is selected from surfactants, conventional builders, bleaches, detergent enzymes, enzyme stabilizers, suspending agents, compatibilizing agents, foam regulators, optical brighteners, opacifiers, corrosion inhibitors, anti-static agents, dyes, bactericides, bleach activators, and peracid bleach precursors.

10. A method of cleaning soiling material from a substrate soiled therewith comprising contacting said substrate with an aqueous solution comprising a surfactant, an effective detergency building amount of lactobionic acid or a lactobionic acid salt, and a boron/oxygen compound for a time sufficient for said solution to remove some of said soiling material, and thereafter removing said substrate from said solution.

11. A method according to claim 10, wherein said boron/oxygen compound is a perborate bleaching agent.

12. A method according to claim 10, wherein said substrate comprises a textile fabric.

* * * * *